United States Patent [19]

Kump

[11] Patent Number: 4,962,859

[45] Date of Patent: Oct. 16, 1990

[54] LITERATURE DISPLAY BOX AND FOLDABLE BLANK FOR FORMING SAME

[75] Inventor: Danny J. Kump, Mayfield, Ohio

[73] Assignee: Gerald Conway & Company, Cleveland, Ohio

[21] Appl. No.: 335,861

[22] Filed: Apr. 10, 1989

[51] Int. Cl.[5] ..... A47F 7/00

[52] U.S. Cl. ..... 211/50; 248/174; 229/108

[58] Field of Search ..... 211/50, 73, 132; 248/174; 206/45.25, 45.24; 229/108

[56] References Cited

U.S. PATENT DOCUMENTS

| | | | |
|---|---|---|---|
| 2,324,232 | 7/1943 | Pantalone | 211/73 |
| 2,677,469 | 5/1954 | Ebert | 211/73 |
| 3,494,479 | 2/1970 | Martin | 248/174 X |
| 3,884,410 | 5/1975 | Giesecke | 211/50 X |
| 4,138,012 | 2/1979 | Dutcher et al. | 248/174 X |
| 4,228,904 | 10/1980 | Dumond | 211/73 X |
| 4,512,541 | 4/1985 | Lietzke | 206/45.25 X |
| 4,579,232 | 4/1986 | Fedak | 211/132 X |
| 4,630,731 | 12/1986 | Albery | 211/50 X |

*Primary Examiner*—Robert W. Gibson, Jr.

*Attorney, Agent, or Firm*—Fay, Sharpe, Beall, Fagan, Minnich & McKee

[57] ABSTRACT

A fold-up blank die cut from a planar sheet of thin plastic material is readily assembled into a literature display box having rectangular bottom, front and rear walls with the rear wall being substantially higher. The side edges of the bottom wall include fold-up slit forming tabs, and the front and back walls both include side wall panels which on the edges contiguous with the bottom wall have arrowhead tabs which may be inserted into the respective slits as the front and back walls are folded up and the side wall panels folded toward each other. The side wall panels on the front wall overlap the side wall panels on the back wall, with the latter including rearwardly inclined outer edges against which the front wall abuts, and which forms a substantial continuation of the side edges of the front wall.

25 Claims, 2 Drawing Sheets

LITERATURE DISPLAY BOX AND FOLDABLE BLANK FOR FORMING SAME

DISCLOSURE

This invention relates generally as indicated to a literature display box and a foldable blank for forming such box. More particularly the invention relates to a blank for a literature display or holder which ships flat in a compact package and which can be readily assembled into a low-cost, free-standing, take-one literature holder and display.

BACKGROUND OF THE INVENTION

Free-standing, take-one literature holders and displays are frequently used on counters, tabletops and the like, in offices, banks, restaurants, or retail stores, for example. Such holders and displays are usually injection molded rigid boxes which are fairly expensive, but even more expensive to ship and store in inventory.

In prior application for U.S. Pat. No. 177,485, entitled "Display Box and Foldable Blank", filed Apr. 1, 1988, there is described a literature box formed of relatively rigid plastic planar panels from a fold-up blank. While addressing the problem of a literature box which may be shipped flat for assembly by the user, the molds on dies for producing the blank in the molding process are nonetheless quite expensive.

Attempts have been made to provide a low-cost, fold-up literature display box formed from thin plastic sheet as seen in prior U.S. Pat. No. 4,630,731. In such prior patent the blank is vacuum formed to include three-dimensional wall panel portions and circular finger projections for assembly. This distorts the plastic material and provides a bulky package for shipment. Moreover, the appearance of the box when formed may detract from the literature being displayed. Other types of fold-up display boxes are seen in U.S. Pat. Nos. 1,909,472, 4,579,232, and 2,125,725.

SUMMARY OF THE INVENTION

A fold-up blank die cut from a planar sheet of thin plastic material is readily assembled into a literature display box having a rectangular bottom, front and rear walls with the rear wall being substantially higher. The side edges of the bottom wall include fold-up, slit forming tabs and the front and back walls both include side wall panels which on the edges contiguous with the bottom wall have arrowhead tabs which may be inserted into the respective slits as the front and back walls are folded up and the side wall panels folded toward each other. The side wall panels on the front wall overlap the side wall panels on the back wall, with the latter including rearwardly inclined outer edges against which the front wall abuts, and which forms a substantial continuation of the side edges of the front wall.

To the accomplishment of the foregoing and related ends the invention, then, comprises the features hereinafter fully described and particularly pointed out in the claims, the following description and the annexed drawing setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
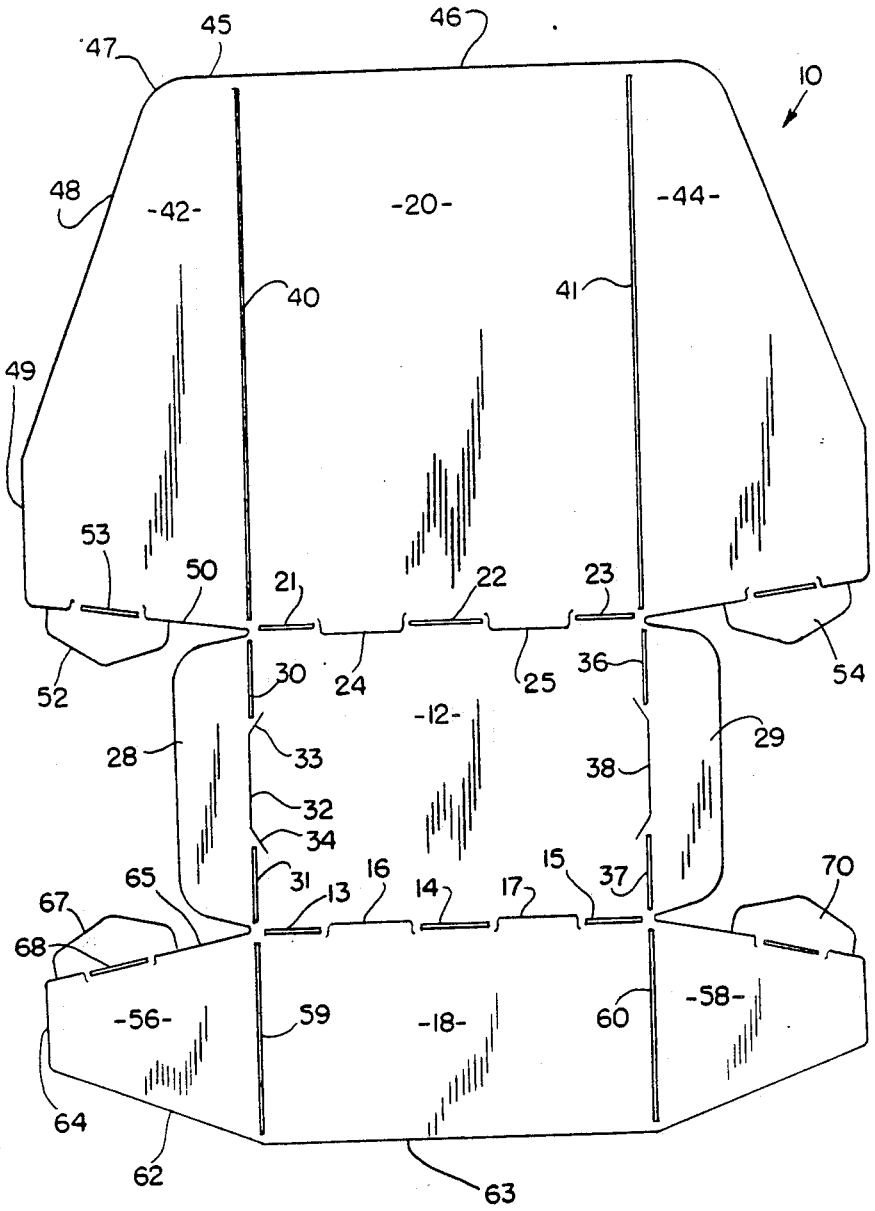
FIG. 1 is a plan view of a fold-up planar plastic sheet blank in accordance with the present invention.

Referring first to FIG. 1, there is illustrated a blank shown generally at 10 from which the literature box of the present invention may be assembled. The blank is die cut from a thin sheet of plastic material such as clear PVC and may be on the order of 12 gauge or 0.012 inches in thickness. In any event, the sheet is planar and provides planar unmarred surfaces for the various walls of the box to be formed.

In the illustration of the blank shown, a double line indicates scoring which is a U-shape groove which extends approximately halfway through the thickness of the plastic sheet and is on the surface of the sheet facing the viewer. A single line, on the other hand, illustrates a slit which extends completely through the sheet.

The blank includes a rectangular bottom wall 12 which along the front edge is provided with three spaced scorings seen at 13, 14 and 15, between which are U-shape slits 16 and 17. In this manner the bottom wall is hinged to a front wall 18 which is also rectangular in configuration.

Next to the back edge of the bottom wall is a rear wall 20. The edge connection is again formed by spaced scorings 21, 22 and 23 and intermediate U-shape slits 24 and 25.

It is noted that the front, bottom and back walls are of the same uniform width, but that the back wall 20 is about 2½ times the length, or height when folded, of the front wall.

Extending from the side edges of the bottom wall 12 are relatively short fold-up tabs seen at 28 and 29. The tab 28 is connected to the side of the bottom wall by spaced scorings 30 and 31 with slot-forming slit 32 therebetween. The slit is provided with inwardly directed angled ends seen at 33 and 34 so that when the tab 28 is folded up a slot is formed at the bottom edge of the fold-up tab. The fold-up tab 29 is connected to the opposite side edge of the bottom wall in the same manner by scorings 36 and 37 with slot forming slit 38 therebetween.

Hingedly connected to each side of the back wall 20 through the scorings indicated at 40 and 41 are first side wall panels 42 and 44, which, as seen, are mirror images of each other. The side wall panels include an end edge 44 which is a continuation of the end edge 46 of the back wall. The end edge, of course, becomes the upper edge when the blank is folded. The end edge extends through a radius 47 into an angled outer edge 48 which comprises the major extent of the outer edge of the side wall panel. The outer edge extends to edge 49 which is parallel to the scoring 40. From the parallel edge 49 to the back wall-bottom wall hinge, the side wall panel includes an edge 50. The edge 50 forms an acute angle which is slightly less than 90° with the scoring 40 which is the side edge of the back wall. In this manner, when the box is assembled the rear wall will extend slightly forwardly. The edge 50 includes a fastening tab 52 which is in the form of a broad arrowhead and scoring is provided as indicated at 53 to permit the tab to hinge toward the viewer.

The opposite side wall panel 44 has the same edge configuration and on the inner or lower edge when folded includes the hinged arrowhead fastening tab 54.

Hinged to each side of the front wall 18 are second side wall panels 56 and 58 which are hinge connected to the side edges of the front wall 18 by the scoring indicated at 59 and 60, respectively. The side wall panels 56 and 58 each include an outer edge (again, upper when folded) 62 which extends from the edge 63 of the front panel to edge 64 which is parallel to the scoring 59 which forms the side edge of the front panel. The side edge includes an angled inner edge 65 which extends at an acute angle with respect to the scoring 59, such acute angle being slightly greater than the angle between the edge 62 and the scoring 59. The edge 65 is provided with the arrowhead fastening tab seen in 67 which again includes scoring indicated at 68 to permit the tab to be folded normal to the plane of the side panel 56. The opposite side panel 58 is, of course, a mirror image of the side panel 56 and includes arrowhead fastening tab 70.

Figure 2:
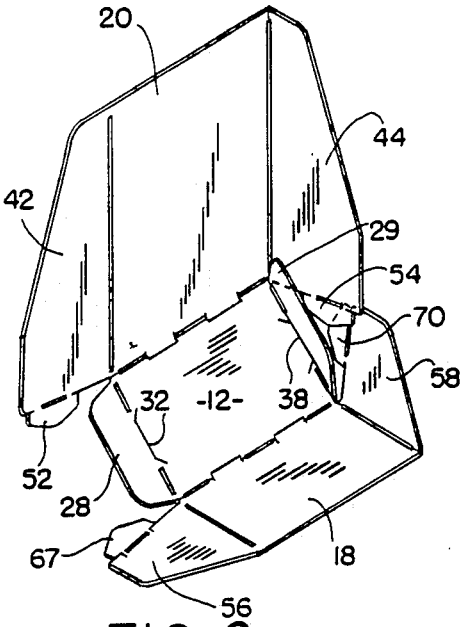
FIG. 2 is an isometric view on a reduced scale of the blank being assembled.
Figure 3:
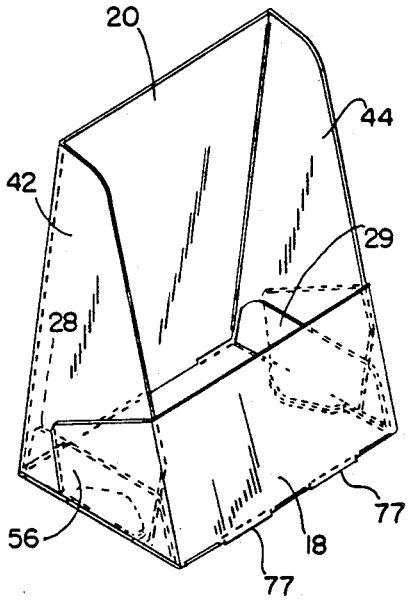
FIG. 3 is an isometric view of a somewhat larger scale of the box fully assembled.

Referring now to FIG. 2, it can be seen that the blank may be assembled or folded into the literature box of the present invention, first by firmly bending all scores or hinge lines and folding up the two fold-up tabs 28 and 29. Then, folding up the back wall 20, the side walls panels are folded forwardly and the tabs 52 and 54 are inserted in the slots 32 and 38. Finally, the front wall is folded up and the second side wall panels 56 and 58 are folded rearwardly overlapping the side wall panels 42 and 44 and the fastening tabs 67 and 70 are also inserted through the slots 32 and 38 to form the literature box as seen in FIG. 3. In the assembled condition, the box at the bottom wall is approximately three inches deep and slightly over four inches wide. The back wall extends upwardly approximately five and one-half inches and is ideally suited to contain take-one literature as indicated at 74 in FIG. 4. In this manner the major portion of literature is exposed to the viewer and the user of the literature box may also include a message on the front planar wall 18.

Figure 4:
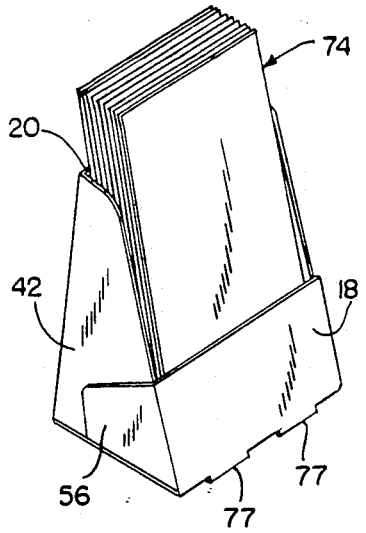
FIG. 4 is a similar view showing literature in the box.
Figure 5:
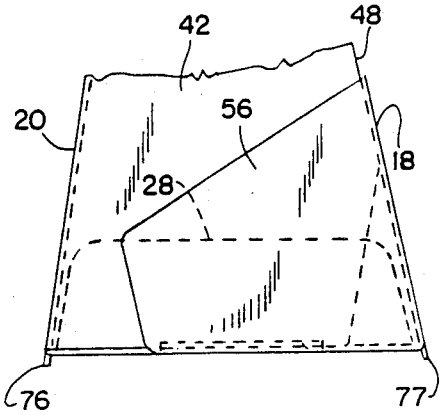
FIG. 5 is an enlarged partially broken away side elevation of the box.

As seen in FIGS. 3, 4 and 5, the major edge 48 of the first side wall panels 42 and 44 is substantially aligned with the front wall 18 of the literature box and in fact the lower portions of the edges 48 abut against the inside of the front wall at the side edges.

Also, as the front and rear walls are folded up, the slits 16, 17, 24 and 25 form slightly downwardly extending projections as seen at 76 and 77. These projections act as stabilizing feet to prevent the box from rocking forwardly or rearwardly.

When the box is assembled at the side lower edges there is provided three overlapping parts. The inner part, of course, is the fold-up tabs 28 and 29. The intermediate parts are the lower portions of the first side wall panels 42 and 44, and the outer parts are the second side wall panels 56 and 58.

It can now be seen that there is provided a low cost literature display box and foldable blank for forming such box, which blank may be shipped flat and in a fairly compact package. Moreover, the box when assembled has the appearance of a more costly box.

I claim:

1. A literature display box comprising a bottom wall, a front wall hinged to the front edge of said bottom wall, a back wall hinged to the back edge of said bottom wall, first side wall panels hinged to each side of said back wall and secured to the respective side edge of said bottom wall, and second side wall panels hinged to each side of said front wall and secured to the respective side edge of said bottom wall, said second side wall panels overlapping the respective first side wall panels.

2. A display box as set forth in claim 1 wherein the edge of said side wall panels hinged to the sides of the front wall contiguous with the bottom wall extends at an acute angle with respect to the side of said front wall whereby the front wall extends rearwardly inclined from the bottom wall.

3. A display box as set forth in claim 2 wherein the side wall panels hinged to the sides of the back panel include an inclined outer edge abutting against said front wall at the side edges thereof.

4. A display box as set forth in claim 1 wherein said bottom wall includes fold-up tabs at each side edge fitting within the overlapped side wall panels.

5. A display box as set forth in claim 4 including a slit in said fold-up tabs, each side wall panel including a fastening tab fitting through the respective such slit.

6. A display box as set forth in claim 5 wherein each fastening tab comprises an arrowhead tab.

7. A display box as set forth in claim 1 wherein said back wall is higher than said front wall, and said front wall is inclined rearwardly.

8. A display box as set forth in claim 7 wherein said side wall panels hinged to each side of the back wall include an outer edge at substantially the same angle of inclination as said front wall.

9. A display box as set forth in claim 1 wherein said display box is formed of thin plastic.

10. A literature display box comprising a bottom wall hinged to the front edge of said bottom wall, a back wall hinged to the back edge of said bottom wall, first side wall panels hinged to each side of said back wall and secured to the respective side edge of said bottom wall, and second side wall panels hinged to each side of said front wall and secured to the respective side edge of said bottom wall, said second side wall panels overlapping the respective first side wall panels.

11. A display box as set forth in claim 10 wherein the edge of the second side wall panels contiguous with said bottom wall extends at an acute angle with respect to the side of said front wall whereby said front wall extends rearwardly inclined from said bottom wall.

12. A display box as set forth in claim 10 wherein said first side wall panels include an outer edge substantially aligned with said front wall.

13. A display box as set forth in claim 12 wherein said first side wall panel outer edge and said front wall are rearwardly inclined from said bottom wall.

14. A display box as set forth in claim 10, wherein said bottom wall includes fold-up tabs at each side edge fitting within the overlapped side wall panels.

15. A display box as set forth in claim 10, including a slit in said fold-up tabs, each side wall panel including a fastening tab fitting through the respective such slit.

16. A display box as set forth in claim 15 wherein each fastening tab comprises an arrowhead tab.

17. A display box as set forth in claim 10 wherein said back wall is higher than said front wall, and said front wall is inclined rearwardly.

18. A display box as set forth in claim 10 wherein said display box is formed of thin plastic sheet.

19. A fold-up blank for a literature display box comprising a bottom wall, a front wall and a back wall connected to front and back edges of said bottom wall by score lines, fold-up tabs at each side of said bottom wall connected thereto by score lines and a center slit, side walls connected to each side of said front and back walls by score lines, said side walls each including projecting fastener tabs on the edge thereof contiguous with the bottom wall whereby when the fold-up tabs are folded up, the front and back walls are folded up, and the side walls folded toward each other, said fastener tabs may be inserted into the center slits of each fold-up tab to secure the box in assembled condition.

20. A blank as set forth in claim 19 wherein said fastening tabs are arrowhead tabs.

21. A blank as set forth in claim 19 wherein said score lines connecting the front and back walls to the bottom wall include U-shape slits adapted to form stabilizing feet for the box when the front and back walls are folded up.

22. A blank as set forth in claim 19 wherein said front, back and bottom walls are each the same width, but said back wall extends more than twice the distance as said front wall from said bottom wall.

23. A blank as set forth in claim 19 wherein the fastening tab edges of the side walls connected to the front wall extend at an acute angle to the edge of the front wall whereby the front wall will extend upwardly at a rearwardly inclined angle when fastening the tab is inserted in the slit.

24. A blank as set forth in claim 23 wherein the side walls connected to the back wall include an angled edge which is in substantial alignment with the front wall when the box is in assembled condition.

25. A blank as set forth in claim 19 wherein said blank is die cut from a planar sheet of thin plastic material.

* * * * *